US005634399A

United States Patent [19]

Pepin et al.

[11] Patent Number: 5,634,399

[45] Date of Patent: Jun. 3, 1997

[54] METHOD AND APPARATUS FOR ADDING PATTERNS TO GOLF BALLS

[75] Inventors: Steve Pepin, Acushnet; Roger Poulin, Mattapoisett, both of Mass.

[73] Assignee: Acushnet Company, Fairhaven, Mass.

[21] Appl. No.: 340,850

[22] Filed: Nov. 17, 1994

[51] Int. Cl.[6] ..... B41F 17/00

[52] U.S. Cl. ..... 101/35; 101/395; 101/483

[58] Field of Search ..... 101/41, 163, 170, 101/395, 401, DIG. 40, 401.1, 35

[56] References Cited

U.S. PATENT DOCUMENTS 4,803,922 2/1989 Dennesen ..... 101/41

FOREIGN PATENT DOCUMENTS 3714327 11/1988 Germany ..... 101/170

0189852 11/1982 Japan ..... 101/170

*Primary Examiner*—Christopher A. Bennett

*Attorney, Agent, or Firm*—Pennie & Edmonds

[57] ABSTRACT

The present invention is directed to a method and apparatus for adding patterns to golf balls. The apparatus used in carrying out the method is a pad printing cliche which comprises a substantially planar substrate having deposited thereupon along at least a portion of its surface a coating of titanium carbon nitride. The coating may range between about 0.1 and 50 microns in thickness, preferably between about 0.25 and 20 microns, more preferably between about 0.5 and 12 microns and most preferably between about 0.5 and 5 microns. The method of the invention comprises providing a pad printing cliche with a coating of titanium carbon nitride, forming a pattern upon said coated surface adapted for transfer to an outer surface of a golf ball, said pattern comprising any combination of words, numbers, designs, etc.; depositing a coating of ink upon at least the patterned portion of the cliche, optionally removing excess ink from the cliche, transferring the pattern from the cliche to a second surface such as an ink transfer pad and contacting the ball surface with the ink transfer pad to transfer the pattern from the pad to the ball.

16 Claims, 1 Drawing Sheet

0.400
0.370

15.750
14.826
13.427
11.701
10.302
8.576
7.177
5.451
4.052
2.326
0.927
0
0.984
3.937
4.921
5°
TITLEIST
9703-8862-BPII
TOUR DISTANCE + 90°
0.074
1
2
3
4

METHOD AND APPARATUS FOR ADDING PATTERNS TO GOLF BALLS

BACKGROUND OF THE INVENTION

Golf balls have been known since at least the 15th century AD when a leather sack was shrunk around wet goose feathers to form a small ball that could be hit around a grassy field. As golf ball technology has progressed manufacturers of golf balls sought to identify their product so the public could recognize their golf ball. While originally golf ball manufacturers embossed their golf balls with their logo and/or company name, at present it has become the custom and practice of the golf industry to print a companies name or logo on golf balls.

Printing a company name and/or logo on a golf ball can be a problematic endeavor. Not only is the cover of a golf ball spherical and dimpled, but it is also made of natural or synthetic materials that usually have a Shore D hardness greater than 50. These properties make printing on the surface of golf balls difficult. In particular, it has been found that pad print cliches as a part of the apparatus used in the application of patterns such as company names, logos and trademarks to golf balls wear down relatively quickly. Once wear has occurred the pattern applied to the golf ball can become defective, resulting in the production of poor quality golf balls that cannot be sold, thereby raising the cost of manufacturing balls.

Further, when a pad print cliche wears down to the point were poor quality golf balls are being produced that cliche has to be changed. The process by which the pad print cliches are changed requires the apparatus that prints a pattern on a golf ball to be turned off. This again wastes valuable time and money during the golf ball manufacturing process. Accordingly, there is a need for an improved cliche for use in adding patterns to golf balls.

SUMMARY OF THE INVENTION

It is an object of the present invention to provide a titanium carbon nitride pad printing cliche which can be used for a larger number of cycles than prior art cliches.

It is a further object of this invention to provide a titanium carbon nitride pad printing cliche which has an improved lifetime such that it needs to be replaced less often than prior art cliches.

It is still yet a further object of the claimed invention to provide a cliche which represents a cost savings over prior art cliches.

Other objects of this invention will be apparent to those skilled in the art to which this invention pertains.

These and other objects can be attained by a method of applying a pattern to a spherical and dimpled surface such as a golf ball wherein a titanium carbon nitride pad printing cliche is used to transfer ink onto the pad used to add the ink onto the spherical and dimpled surface.

This invention further relates to a cliche for use in an apparatus employed to add a pattern to a golf ball wherein the improvement comprises a coating of titanium carbon nitride on the surface of the cliche.

DETAILED DESCRIPTION OF THE INVENTION

Figures 1, 2:
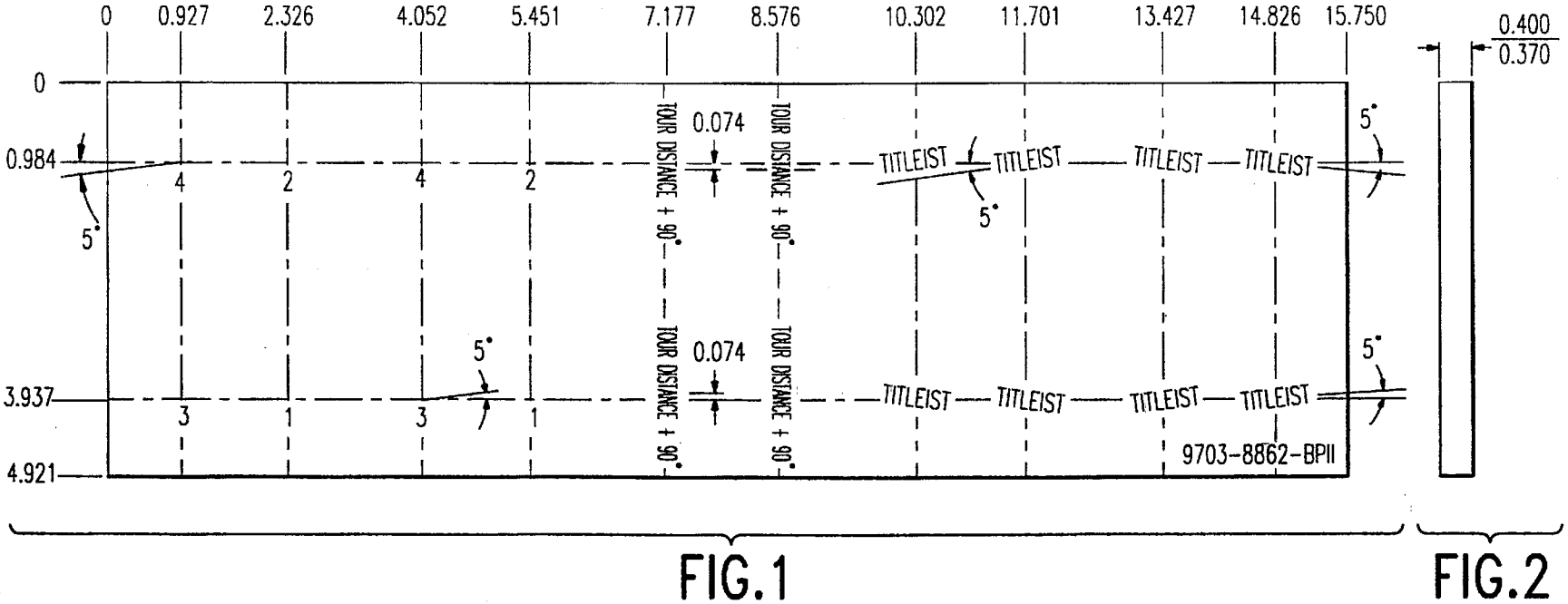
FIG. 1 is a graphic representation of a titanium carbon nitride coated pad printing cliche according to the present invention.
FIG. 2 is an end view of a titanium carbon nitride coated pad printing cliche according to the present invention.

The present invention is directed to a method of using titanium carbon nitride coated cliches in processes for adding patterns to spherical dimpled surfaces such as golf balls.

Titanium Carbon nitride is a hard material whose methods of manufacture and use has been extensively documented in recent years. See for example, Teyssandier etal., "On The Theoretical Conditions Of Chemical Deposition Of Refractory Solid Solutions: Titanium Carbonitride", Journal Of Materials Science Letters 3'(1984) 355–358, and U.S. Pat. Nos.: 5,252,360 to Huttl et al., 4,411,960 to Mizuhara, 4,574,459 to Peters, 4,950,365 to Evans, 5,314,656 to Munir et al. 3,912,461 to Wakefield, 4,463,033 to Kikuchi and Itaba et al. to 4,337,300 to Itaba et al.

The present invention is directed to a method of using titanium carbon nitride coated cliches as a part of an apparatus used in a method of adding patterns, such as logos, trademarks and company names, to golf balls.

A cliche is a planar material that is used to transfer ink to a second material, such as a silicon pad, which in turn can add the ink to a spherical dimpled surface. Although the present invention is directed to any type of cliche, a preferred embodiment is directed to a cliche which has an etched pattern on its otherwise planar surface.

For purposes of the present invention, ink is taken to mean any compound which can be used to mark the spherical dimpled surfaces of the claimed invention. Ink is specifically meant to encompass natural and synthetic dies, monomeric and polymeric colored compounds, including decals, and fluorescent compounds. Those skilled in the art are well aware of these classes of compounds and there use.

The spherical dimpled surfaces referred to herein can be any material that is both spherical and dimpled. In a preferred mode of the present invention, the spherical dimpled surface is the cover of a golf ball. Within this preferred class of golf balls, sizes of about 1.68 inches as well as those falling in the range of from about 1.70–1.74 inches are specifically contemplated for use in the present invention.

When used in a printing process according to the present invention, at least the etched portion of the surface of the cliche will be covered with ink. The ink is spread over the etchings, using, for example, a flooder blade with a forward sweeping motion. A second blade can then be used to wipe off the ink from the planar surface of the cliche without removing the ink from the etched depressions on the cliche. Transfer pads, made of, for example silicon, are then pressed on the cliche to pick up the ink remaining in the etches.

In a preferred mode of the present invention the inked transfer pads to an over-ball position where a regulated air flow is applied to the inked surface. The transfer pads are then contacted with the surface of the golf ball such that the tacky ink is added to a spherical surface.

The titanium carbon nitride pad printing cliches according to the claimed invention can be made by any method known to one of ordinary skill in the art. It is well know in the materials science art that many different techniques can be used to prepare a given cliche. Different methods of manufacture can involve more or less costly raw materials, straightforward or cumbersome scaleup, higher and lower amounts of defective final products and longer and shorter lifetime materials. The skilled material science engineer knows well how to balance the competing characteristics of manufacture. Thus the cliches of the present invention are not intended to be limited by the specified method of manufacture and any method of producing the claimed titanium carbon nitride cliches can be used.

The titanium carbo-nitride cliche that is used according to the claimed invention can be made by rough and finish grinding an A2 Electro Slag Remelt Blank to specification dimensions. The specification dimensions can be any that would achieve the intended result of the present patent. In a preferred mode the dimensions disclosed on the accompanying drawing is used.

The blank so produced is then A2 steel ground and diamond lapped to a fine finish to produce a lapped steel blank. In a preferred mode the blank is ground to a 4–6 micro inch finish. The lapped steel blank is then cleaned in solution, lightly oiled and wrapped in 60# vci (corrosion resistant) paper for shipping to a plate etcher. Any corrosion resistant paper not deleterious to the blank may be used in the present invention, such classes of paper are well known to the skilled artisan.

The steel blank is prepared for chemical milling with a photo-sensitive emulsion and masking compound prior to ferric chloride treatment using known techniques to produce an etched design in the plate. It is noted that while the etching technique is the preferred mode, any technique which will produce a plate having a design therein can be used in the present invention. In particular, stamped, deposited or cast plates may also be used in the present invention.

The etched or otherwise patterned plate is cleaned in solution, inspected for specified depth of etch and final inspected for any etching or surface flaws. It is preferred to have a pattern that is between 1 and 50 microns deep on the plate surface. The more preferred depth is between 10 and 25 microns. The most preferred depth is between about 15 and 19 microns.

Finished plates can be lightly oiled and rewrapped in corrosion resistant paper for shipment to a coating facility. Specially designed shipping boxes holding a maximum of 3 plates each can be utilized from all shipping points to minimize plate damages.

The TiCN Coater can clean the etched plate using for example a stripping solution well known to those of ordinary skill in the art. The etched plates can be vacuum degassed to remove surface impurities and the plate(s) to be coated can be situated in the TiCN coating vessel by, for instance, means of mechanical grip fixture, such as a clamp. A thin film coating of TiCN, of from about, 0.1–50 microns, or more preferably 0.25–20 microns, or most preferably 0.5–5 microns in thickness, can be added to the etched surface of the cliche by for example Richter Precision Inc. using their proprietary Titankote and C4 process, or, by Balzer Tool Coating, Inc. using their TiCN proprietary process. It is noted that any coating method for adding a thin film of TiCN to a metal substrate can be used including vapor deposition techniques well known in the art.

The finished plates can be inspected for coating adhesion, thickness of coating and any surface flaws and then wrapped and repackaged for shipment.

All references, patents and other printed publications identified in this patent are herein incorporated by reference in their entirety.

EXAMPLES

In order to exemplify the results achieved using the titanium carbo nitride coated cliches of the present invention, the following examples are provided without any intent to limit the scope of the instant invention to the discussion therein, all parts and percentages are by weight unless otherwise indicated.

Example 1

The following is an example of a method of producing a titanium carbo-nitride cliche that is used according to the claimed invention. An A2 Electro Slag Remelt Blank is rough and finish ground to specification dimensions. The blank so produced is then A2 steel ground is diamond lapped to 4–6 micro inch finish to produce a lapped steel blank. The lapped steel blank is then cleaned in solution, lightly oiled and wrapped in 60# vci (corrosion resistant) paper for shipping to a plate etcher. The steel blank is prepared for chemical milling with a photosensitive emulsion and masking compound prior to ferric chloride treatment using known techniques to produce the designated Titleist Golf Ball stamp artwork. The etched plate is cleaned in solution, inspected for specified depth of etch (15–18 microns) and final inspected for any etching or surface flaws. Finished plates are lightly oiled and rewrapped in the 60# vci (corrosion resistant) paper for shipment to the coaters facility. Specially designed shipping boxes holding a maximum of 3 plates e re utilized from all shipping points to minimize plate damages.

The TiCN Coater cleans the etched plate using stripping solution. The etched plates are vacuum degassed to remove any surface impurities and each plate to be coated is situated in the TiCN coating vessel by means of mechanical grip fixture. A thin film coating of TiCN, about 1–5 microns in thickness, is added to the etched surface of the cliche by Richter Precision Inc. using their proprietary Titankote and C4 process, or by Balzer Tool Coating, Inc. using their TiCN proprietary process. The finished plates are inspected for coating adhesion, thickness (1–5 microns) and any surface flaws and then wrapped and repackaged for shipment.

Example 2

The finished TiCN coated Pad Print Cliche is utilized in the Titleist Golf Ball Stamping Process, through transfer pad technology. The dimension and artwork gravure impressions on the TiCN coated Cliche are strategically positioned to match up with the custom ink well to optimize efficiency of set-up and/changeovers. After the plates are mechanically locked in the tooling well, ink is spread over the etchings via a flooder blade with a forward sweeping motion. On the reverse sweeping motion thin stainless steel blades that are 0.750" wide and 1.562" long with a 0.004" edge (called doctor blades) are applied to the cliche under pressure to sweep ink off the TiCN surface of the cliche plate. Transfer pads (silicone pads) are automatically pressed onto the TiCN coated plate to pick up the ink remaining in the etches. The inked pads travel to over-ball positions where regulated air flow applied to the pads induces setting of the ink on the pads. The pads then are recycled to press on the balls to have the silicone pads transfer the tacky ink impressions onto the golfballs using an apparatus called the Tampo-Print Model TS-125.

The scope of the following claims is intended to encompass all obvious changes in the details, materials, and arrangement of parts that will occur to one of ordinary skill in the art.

We claim:

1. An improved method of applying a pattern to an outer surface of a golf ball which comprises:

producing a pattern adapted for application to a golf ball upon a first surface, said first surface forming a portion of a pad printing cliche;

depositing ink upon at least the portion of said cliche having said pattern to produce an inked pattern upon said cliche;

transferring said inked pattern from said cliche to a second surface, said second surface comprising a transfer pad; and contacting an outer spherical portion of a golf ball surface with said transfer pad to transfer said inked pattern to said ball surface, wherein the improvement comprises depositing upon at least the portion of said cliche to which said pattern is applied a coating of titanium carbon nitride prior to production of said pattern thereupon.

2. The method of claim 1 wherein said titanium carbon nitride coating is deposited upon said cliche to a thickness of between about 0.1 microns and about 50 microns.

3. The method of claim 1 wherein said titanium carbon nitride coating is deposited upon said cliche to a thickness of between about 0.25 microns and about 20 microns.

4. The method of claim 1 wherein said titanium carbon nitride coating is deposited upon said cliche to a thickness of between about 0.5 microns and about 12 microns.

5. The method of claim 1 wherein said titanium carbon nitride coating is deposited upon said cliche to a thickness of between about 0.5 microns and about 5 microns.

6. The method of claim 1 wherein the pattern is formed upon said cliche by etching it into said titanium carbon nitride coating.

7. The method of claim 1 wherein the pattern is formed upon said coated cliche by a process selected from the group consisting of stamping, deposition and casting.

8. The method of claim 1 which further comprises removing excess ink from said ink coated cliche without substantially removing said ink from said pattern.

9. The combination of a golf ball and a cliche for applying a pattern to an outer surface of the golf ball wherein a coating of titanium carbon nitride is provided upon at least a portion of an outer surface of said cliche.

10. The combination of claim 9 wherein said titanium carbon nitride coating has a thickness of from about 0.1 microns to about 50 microns.

11. The combination of claim 9 wherein said titanium carbon nitride coating has a thickness of from about 0.5 microns to about 12 microns.

12. The combination of claim 9 wherein said titanium carbon nitride coating has a thickness of from about 0.5 microns to about 5 microns.

13. The combination of claim 9 wherein said titanium carbon nitride coating is applied upon a metal substrate.

14. The combination of claim 13 wherein said metal substrate is steel.

15. The combination of claim 9 wherein said titanium carbon nitride coating is applied upon a substrate comprising a metal alloy.

16. In an improved golf ball stamping apparatus for applying a pattern to an outer surface of a golf ball, said apparatus comprising a pad printing cliche having, on a first surface thereof, a pattern adapted for application to said golf ball, the improvement comprising a coating of titanium carbon nitride present upon at least a portion of said first surface of said pad printing cliche.

* * * * *